US008561317B2

(12) United States Patent
Warren et al.

(10) Patent No.: US 8,561,317 B2
(45) Date of Patent: Oct. 22, 2013

(54) FACILITY AND SYSTEM FOR DRYING FORAGE

(75) Inventors: Jeff Warren, Penn Yan, NY (US); John E. Davie, Geneva, NY (US)

(73) Assignee: Top Quality Hay Processors LLC, Penn Yan, NY (US)

( * ) Notice: Subject to any disclaimer, the term of this patent is extended or adjusted under 35 U.S.C. 154(b) by 0 days.

(21) Appl. No.: 12/031,583

(22) Filed: Feb. 14, 2008

(65) Prior Publication Data

US 2008/0190086 A1 Aug. 14, 2008

Related U.S. Application Data

(60) Provisional application No. 60/889,817, filed on Feb. 14, 2007.

(51) Int. Cl.
*F26B 1/00* (2006.01)
*F26B 3/04* (2006.01)

(52) U.S. Cl.
USPC ..... 34/381; 34/385; 34/386; 34/423; 34/446

(58) Field of Classification Search
USPC ..... 34/381, 380, 382, 383, 418, 423, 443, 34/446, 491, 496, 385, 386; 56/16.4 B; 426/54
See application file for complete search history.

(56) References Cited

U.S. PATENT DOCUMENTS

| | | | | |
|---|---|---|---|---|
| 2,350,096 | A * | 5/1944 | Chilton | 426/314 |
| 2,597,819 | A | 5/1952 | Provost | |
| 2,601,728 | A | 7/1952 | Erfurth | |
| 3,402,476 | A * | 9/1968 | Brock | 34/500 |
| 3,829,986 | A * | 8/1974 | Ruigrok et al. | 34/216 |
| 4,017,981 | A | 4/1977 | Ingvaldsen | |
| 4,561,194 | A | 12/1985 | Sutch | |
| 5,022,317 | A | 6/1991 | Williams | |
| 5,060,459 | A | 10/1991 | Herron | |
| 5,105,563 | A | 4/1992 | Fingerson et al. | |
| 5,227,183 | A | 7/1993 | Aung et al. | |
| 5,557,859 | A | 9/1996 | Baron | |
| 5,692,317 | A | 12/1997 | Manzolli | |
| 6,202,548 | B1 | 3/2001 | Gombos et al. | |
| 6,223,454 | B1 | 5/2001 | Fingerson et al. | |
| 6,224,916 | B1 * | 5/2001 | Reber | 426/54 |
| 6,485,774 | B1 * | 11/2002 | Bransby | 426/623 |
| 6,754,977 | B2 | 6/2004 | Roberts | |

* cited by examiner

*Primary Examiner* — Jiping Lu
(74) *Attorney, Agent, or Firm* — Greer, Burns & Crain, Ltd

(57) ABSTRACT

A system for drying freshly grown forage involving the steps of placing loose mass forage on a receiving system; transporting the loose mass forage from the receiving system to a detangling mechanism; passing the loose mass forage through the detangling mechanism to break up any large clumps of forage and to create a forage carpet of a substantially uniform thickness; passing the forage carpet through a drying oven containing multiple chambers; drying the forage carpet to moisture content below the desired moisture content for the forage; and adding moisture to the forage carpet to bring the moisture content of the forage up to the desired moisture content.

7 Claims, 3 Drawing Sheets

FACILITY AND SYSTEM FOR DRYING FORAGE

CROSS-REFERENCE TO RELATED APPLICATIONS

This application claims priority from U.S. Provisional Patent Application Ser. No. 60/889,817, filed Feb. 14, 2007 the contents of which are incorporated by reference.

FIELD OF THE INVENTION

This invention relates to transporting and artificially drying forage, and more specifically to a process for cutting freshly grown long strand forage, transporting the forage to a drying facility, artificially drying the forage to a desired moisture content and bailing the forage for storage.

BACKGROUND OF THE INVENTION

It is known in the art of harvesting farm produce that forage, such as hay, grass and alfalfa, have a high moisture content and must be dried before storage to effectively preserve the forage. Dried forage is easier to handle, and has a longer storage life than moist forage. Moist forage is susceptible to mold growth which thereby destroys the forage.

The traditional method for processing forage is to cut the forage when it has reached the bud stage or in early blossom. The forage is then allowed to dry in the sun as a loose mass in the field. The forage is then tedded, raked into windrows and turned so that the sun can dry the remaining material that remained on the ground. If the forage is not sufficiently dry it must also be teddeded a second time, or spread out on the ground again and allowed to dry further. The forage is then raked and windrowed again. Later the forage is baled either into square or large round bales. This process can take up to five days to complete, and may be compromised due to environmental effects such as rain. The long drying period causes the forage to lose some of its nutrients. This method also requires many passes of equipments throughout the process. This is inefficient as many steps are involved, the sun drying is a slow process, and weather is unpredictable.

U.S. Pat. No. 6,754,977 discloses a drying facility that involves baled long strand hay. The baled hay is separated to form a loose mass and fed into a drying facility. However, baling and then separating is undesirable as these additional steps are inefficient, increase waste and reduce the nutritional content compromising the forage quality.

By transporting freshly cut forage to a drying facility the required drying time can be greatly reduce and more of the nutrients can be retained within the forage. However, there lacks an efficient system for transporting moist fresh cut forage without first baling the forage.

It is therefore desired to cut and load forage for transportation without the need for sun drying or baling.

It is further desired to rapidly dry fresh cut forage to a desired moisture content to retain more nutrients.

SUMMARY OF THE INVENTION

The invention provides an improved method for drying forage. Long strand forage, such as hay or alfalfa, is freshly cut in the field and loaded onto a trailer in a loose mass. The forage is then transported to a drying facility where it is unloaded onto a conveyor and formed into a carpet having a uniform thickness. The forage is sent through the drying facility and dried to a predetermined moisture content. The dried forage is then baled and taken to a dark storage facility. The entire process can, in some cases, be completed in as little as 3 hours compared to the multiple days that traditional forage drying methods require. Additionally, the quality of the forage is improved as there is less nutritional loss from the sun, weather and frequent handling of the forage.

An advantage of the present invention is that the forage is quickly loaded for transport during harvesting, thereby reducing any negative environmental effects.

A further advantage of the present invention is that the freshly cut forage is dried to a desired moisture content a short time after cutting thereby retaining more nutrients than drying by traditional methods.

A yet further advantage of the present invention is that the drying facility allows for the drying and baling of custom blends of forage.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate embodiments of the invention but should not be construed as limiting the scope of the invention in any manner.

DETAILED DESCRIPTION

Freshly grown forage includes long strand forage such as hay, grass, or alfalfa. Long strand forage is defined as forage having a height between about 6 inches and 5 feet. Specific types of hay include, but are not limited to alfalfa, timothy grass, orchard grass, clover and straw. The forage is cut in a field and loaded into a transport vehicle as a loose mass.

Forage is cut and transported as a loose mass to a transport vehicle. By transporting the forage as a loose mass the need to bail the forage is eliminated. A transport vehicle either loads the freshly cut forage into a secondary transport vehicle or takes the freshly cut forage directly to a drying facility.

Figure 1:
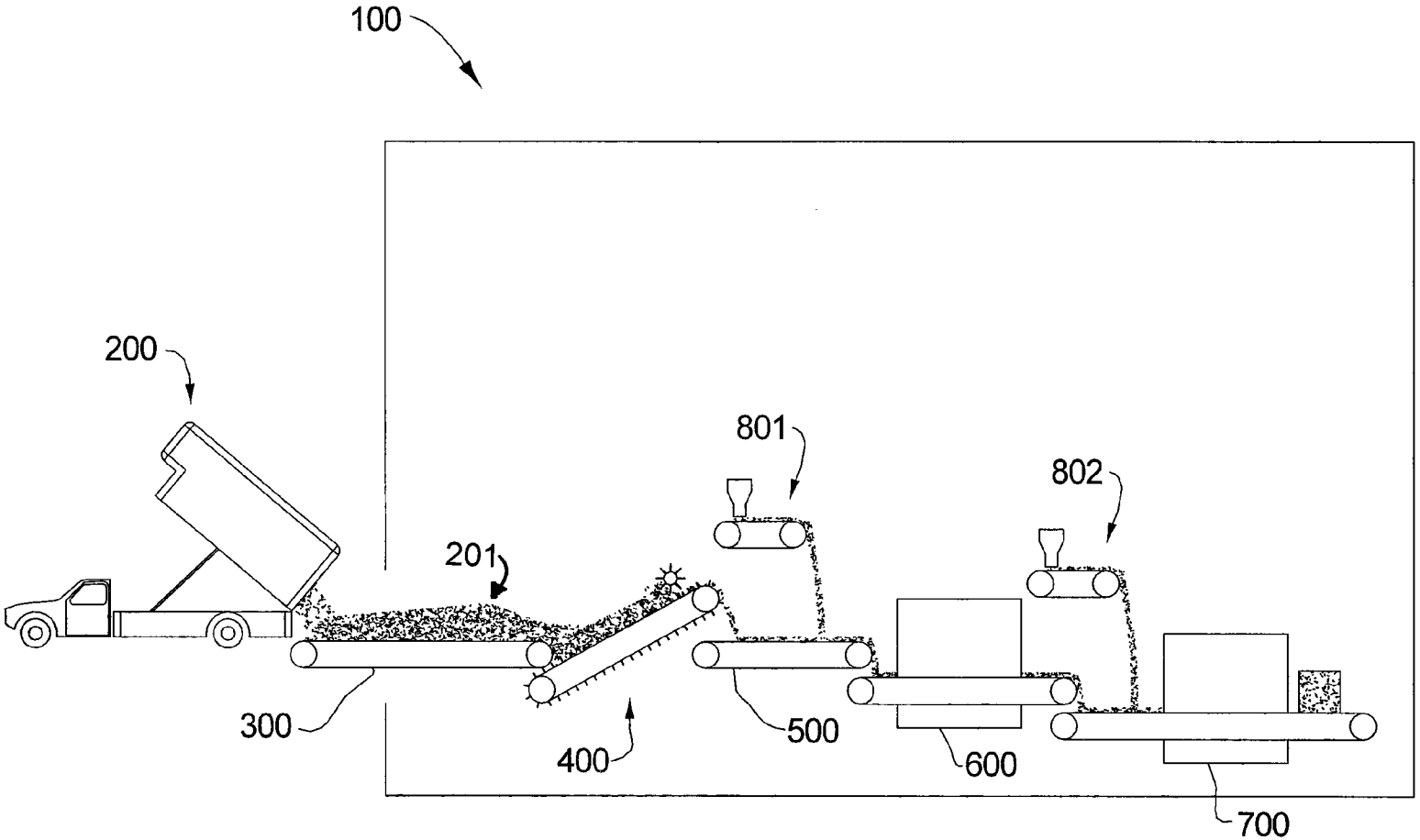
FIG. 1 is a schematic view of the drying facility according to an embodiment of the present invention.

Referring to FIG. 1, the forage 201 is unloaded from a transport vehicle 200 as a loose mass and onto a receiving system 300 such as a conveyer belt that transports the forage into the drying facility 100. The transport vehicle 200 may have a trailer with walking floors or a dumping mechanism to improve the unloading process. In one embodiment, the drying facility has the capacity to dry at least 70,000 pounds of forage a day.

The receiving system 300 has a large capacity for forage to keep the lines within the drying facility fall. The forage is carried from the receiving system to a detangling mechanism 400. In one embodiment a conveyor transports the forage from the receiving system 300 to the detangling mechanism 400. The detangling mechanism separates clumps in the forage and evenly spreads the loose mass onto a holding belt 500 forming a forage carpet on top of the holding belt 500. The carpet is of a substantially uniform thickness that allows for adequate drying of the forage in the drying oven. In one embodiment the forage carpet is about 1 to 16 inches thick. In another embodiment the forage carpet is about 10 inches thick. The carpet may range in width from about 4 to 24 feet depending on size of the drying oven 600 and holding belt 500.

Figure 2A:
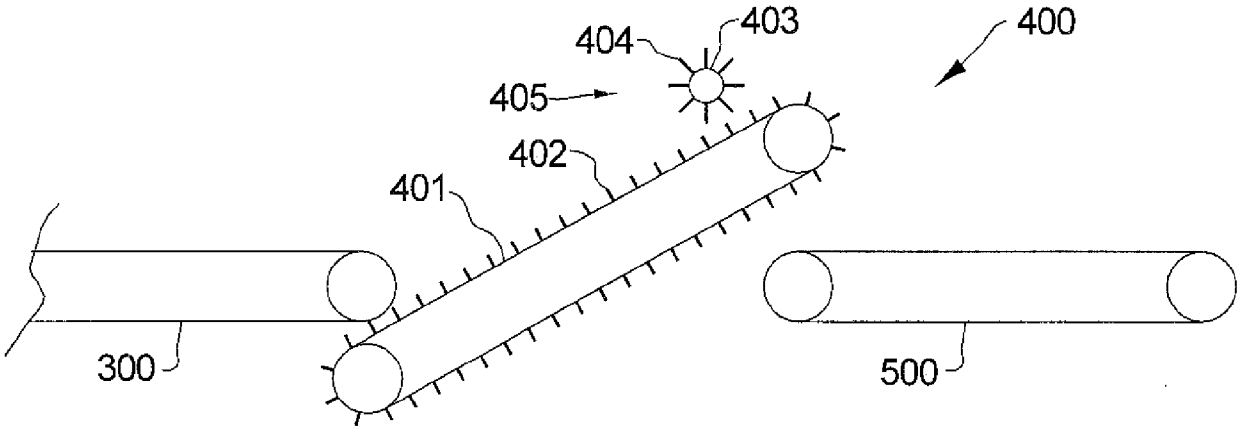
FIGS. 2A-2B are a side schematic view of the detangling mechanism according to an embodiment of the present invention.
Figure 2B:
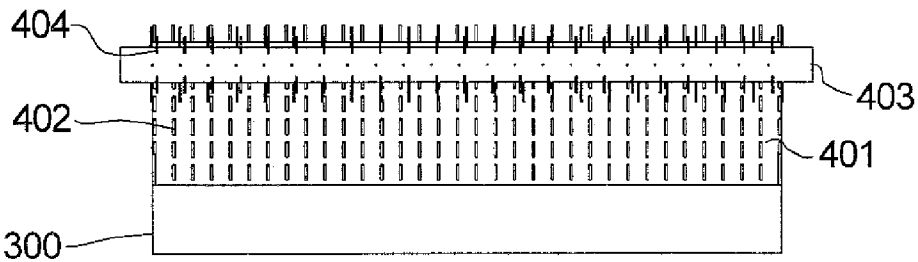

Referring to FIGS. 2A-2B there is shown an embodiment of the detangling mechanism 400. The detangling mechanism 400 contains an inclined conveyor belt 401. The inclined conveyor belt 401 has a plurality of cylindrical rods 402 extending outward from the conveyor belt 401 to grasp the forage and pull the forage up the incline. Extending horizontally above the inclined conveyor belt 401 is a thickness control device 405 that blocks the passage of any forage exceeding the desired thickness. In one embodiment the thickness control device is a rod 403 having a plurality of fingers 404 protruding axially along the surface of the rod 403. The rod 403 rotates such that the fingers 404 travel in the opposite direction as the cylindrical rods 402 traveling up the inclined belt 401. The rotating fingers 404 knock any clumps of forage back down the conveyor belt 401 leaving a carpet of consistent height to pass by the fingers 404. The forage carpet then drops from the top of the inclined belt 401 onto the holding belt 500. The thickness control device's 405 height is adjustable such that the forage carpet thickness is adjustable. It is understood that although the detangling mechanism 400 is described as an inclined belt and rotating fingers any mechanism that is capable of removing clumps and producing a substantially consistent carpet thickness may be used without detracting from the scope of the invention.

Referring again to FIG. 1, the holding belt 500 transports the forage carpet from the detangling mechanism 400 to the drying oven 600. Optionally, as the first carpet is transported from the detangling mechanism 400 to the drying oven 600 a second carpet, of a distinct forage, is dropped from a pre-drying belt 801 onto the first carpet forming a blended carpet. The blended carpet can be any combination of two or more forages.

Figure 3:
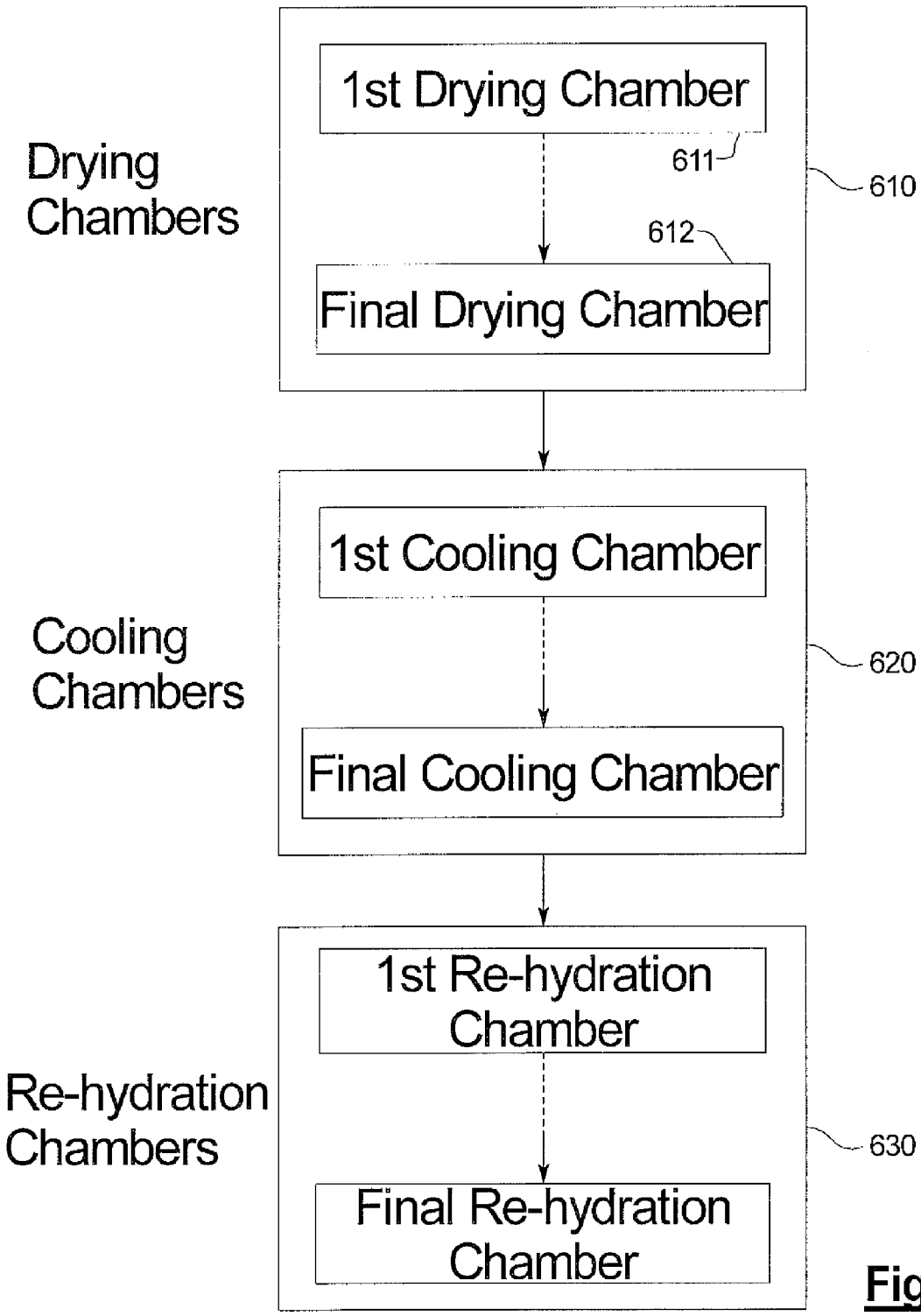
FIG. 3 is block diagram showing the process steps for the drying oven of the present invention.

Referring to FIG. 3, the drying oven 600 contains a plurality of chambers. In one embodiment the drying oven is between about 150 and 200 feet long. The forage carpet or blended carpet enters the drying chambers 610 where drying begins. The drying chambers pass hot air through the forage to promote rapid drying. The first drying chamber 611 is operated at a high temperature while the forage contains a high moisture content. To prevent burning of the forage subsequent drying chambers are operated at lower temperatures. Generally, the final drying chamber 612 is operated at the lowest temperature. As the forage passes through each chamber the temperature and air flow can be modified to account for changes in the moisture content. The air flow is adjustable to move air through the top of the carpet, through the bottom of the carpet or across the carpet. In one embodiment the oven operates at temperatures below 350° F. to prevent burning of the forage. The forage passes through a series of drying chambers until the desired moisture content is reached. For example, in one type of hay the desired moisture content is about 15%.

After passing through the drying chambers 610 the forage enters the cooling chambers 620. The cooling chamber passes cool air through the forage to stop the drying process and to create a uniform forage temperature.

As some forage contains both stalks and leaves it is not possible to dry both the stalks and the leaves to the same moisture content by heating alone. To overcome this problem in one embodiment the moisture content is first taken below the desired moisture content level. For example, in hay the moisture level is taken to about 8%. This lowers the moisture of the leaves well below the desired moisture content, while adequately reducing the moisture of the stalks to or below the desired moisture level. This ultra-dried forage is then transported to a re-humidification chamber, or a series of re-humidification chambers 630. The forage is then exposed to a humid environment to bring the moisture content back up to the desired moisture content level. As the leaves regain moisture faster than the stalks the entire forage achieves a uniform moisture content. In one embodiment, the moist environment is a humidity controlled chamber. In an another embodiment, the moist environment is a heated gaseous fluid, such as steamed water, which passes through the forage carpet transferring moisture to the forage. The heated gaseous fluid can be fresh steam pumped into the system. Additionally, in an alternative embodiment the steam is redirected from the oven heating chambers. The previously removed moisture is recycled for use in the re-hydration chamber.

Optionally, the moist environment is enriched with nutrients. Steam is enriched with nutrients and these nutrients pass from the steam and into the forage as re-hydration occurs thereby enhancing the nutritional value of the forage.

Referring again to FIG. 1, after drying, and re-hydrating if necessary, the forage carpet is transported from the oven 600 to the baler 700. In one embodiment, a plurality of forages are blended after drying and prior to baling in a similar manner as described above prior to drying. A second carpet is dropped from a dried blending belt 802 onto the first carpet. The forage carpet, or blended carpet is baled and taken to a storage facility or immediately shipped. The final bailed forage has a consistent moisture content, is mold-free, dust-free and is more vibrant in color than forage dried by traditional methods.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A method for drying loose mass forage comprising the steps of:

unloading the loose mass forage from a transport vehicle onto a receiving system:

transporting the loose mass forage from the receiving system to a detangling mechanism, said detangling mechanism comprising an inclined conveyor belt having an upper end, a lower end and a plurality of cylindrical protrusions extending from the surface of the conveyor belt; and a thickness control device located near the upper end of the inclined conveyor belt;

passing the loose mass forage through the thickness control device to separate any large clumps of forage and create a forage carpet of a substantially uniform thickness;

transporting the forage carpet to a drying oven containing multiple chambers;

drying the forage carpet to moisture content below the desired moisture content for the loose mass forage; and adding moisture to the forage carpet to bring the moisture content of the loose mass forage up to the desired moisture content, wherein the thickness control device is a rod positioned horizontally over the inclined conveyor belt having a plurality of fingers extending axially from the surface of the rod, the fingers knocking any clumps of loose mass forage back down the inclined conveyor belt leaving a carpet of consistent height to pass by the fingers, wherein the loose mass forage is a long strand forage selected from the group consisting of hay, grass and alfalfa.

2. The method for drying loose mass forage of claim 1 further comprising the steps of:

blending a first type of forage with a second type of forage forming a blended forage carpet;

transporting the blended forage carpet to a baler; and bailing the blended forage carpet into bales.

3. The method of claim 2 wherein the forming of a blended carpet occurs prior to transporting the forage carpet to the drying oven.

4. The method of claim 1 wherein the drying oven does not exceed a drying temperature of 350° F.

5. The method of claim 4 wherein the total drying time is less than three hours.

6. The method of claim 1 wherein the moisture content below the desired moisture content for the forage is about 8% and the desired moisture content is about 15%.

7. The method of claim 1 wherein the step of adding moisture to the forage carpet to bring the moisture content of the loose mass forage to the desired moisture content is done by passing gaseous water enriched with nutrients through the forage carpet.

* * * * *